United States Patent [19]

Wackerbarth

[11] 4,347,106

[45] Aug. 31, 1982

[54] REGENERATIVELY-OPERATED COKE OVEN

[75] Inventor: Folkard Wackerbarth, Bochum, Fed. Rep. of Germany

[73] Assignee: Dr. C. Otto & Comp. G.m.b.H, Bochum, Fed. Rep. of Germany

[21] Appl. No.: 249,811

[22] Filed: Apr. 1, 1981

Related U.S. Application Data

[63] Continuation-in-part of Ser. No. 71,607, Aug. 31, 1979, abandoned.

[51] Int. Cl.[3] ..... C10B 1/06; C10B 5/12; C10B 21/00

[52] U.S. Cl. ..... 202/141; 202/270; 432/2

[58] Field of Search ..... 239/591, DIG. 19; 202/135, 139, 141-144, 241, 151, 270; 201/2, 26; 432/2

[56] References Cited

U.S. PATENT DOCUMENTS 3,192,127 6/1965 Van Ackerman et al. ..... 432/2
3,351,684 11/1967 Lincoln ..... 432/2

*Primary Examiner*—Frank Sever
*Attorney, Agent, or Firm*—Thomas H. Murray; Clifford A. Poff

[57] ABSTRACT

Thin-walled corundum tubes form smooth and pore-free surfaces for supplying non-preheated gas to the burners in heating flues between coking chambers of a coke oven. Silica blocks forming a burner in the heating flues have an enlarged opening to receive the tube so that the tube projects a short distance from the top of the burner and extends therealong below the floor of the heating flue. The tube is made of corundum or similar refractory material to prevent the accretion of carbon which precipitates at a high temperature from the rich gas.

8 Claims, 3 Drawing Figures

REGENERATIVELY-OPERATED COKE OVEN

CROSS-REFERENCE TO RELATED APPLICATION

This application is a continuation-in-part of application Ser. No. 71,607, filed Aug. 31, 1979, now abandoned.

BACKGROUND OF THE INVENTION

This invention relates to a regeneratively-operated coke oven having means for supplying non-preheated gas to the heating flues wherein such means includes a smooth and pore-free surface to prevent accretion of carbon which precipitates from rich gas conducted along a high-temperature surface.

Dry distillation gas produced in a coke oven during the course of a coking process includes a substantial portion of methane. This gas is frequently used for heating the coke ovens. The temperature of the regions of rich gas burners in the heating flues of coke ovens is always higher than 1000° C. during operation of the oven. The temperature may reach 1500° C. to 1600° C. in the regions of rich gas burners for coke ovens to carry out short coking times of, for example, fourteen hours. In some instances, rich gas is used which, like residual synthesis gas, has a higher hydrocarbon content than the distillation gas. When such rich gases are supplied to the heating flues of coke ovens, carbon is precipitated from the gas on the surface of the burners disposed in the heating flues. The present invention is based on the fact that at temperatures in the range of 1000° C. to 1600° C. methane and its homologues have a tendency to dissociate into carbon and hydrogen constituents. The carbon precipitate gradually hardens and transforms into graphite which reduces the cross-sectional areas of the openings in the burners. Particularly thick graphite accretions are formed in the burners which extend far, e.g., 1 meter and more, into the heating flues.

It is a common practice in the regenerative operation of coke ovens to prevent blockage of the burners by introducing air into the rich-gas ducts. The air is used for the purpose of degraphitizing during the particular regenerative hot cycle during which no gas is supplied to the heating flues and the chimney draft which acts on the heating flues is frequently regarded as sufficient for drawing the air into the flues. In some instances, the air for degraphitizing is supplied under pressure into the heating flues. Air has also been introduced into an inoperative burner in a heating flue while gases are burning upwardly in the flue which is possible when several burners are provided in one heating flue. A small quantity of air has also been continuously added to the gas which is supplied to the heating flues. This addition of air to the gas occurs at a point immediately prior to the entry of the gas into the heating flue in order to restrict the precipitation of graphite from the gas.

The air intended for degraphitizing is discharged into the bottom end of a heating flue where a downward combustion occurs in the flue. The discharging of air into the flue increases the air content of the gaseous product flowing to the chimney in the course of the combustion process. The combustion process occurring in the heating flues must be carried out with an excess of air in order to insure complete combustion of the fuel gas. Additional heat must, therefore, be generated for heating the degraphitizing air in the gas supply ducts.

This increases the heat comsumption of the coke oven. On the other hand, if insufficient air is supplied to the heating flues, there is a risk of a breakdown of an oven operation because the ducts and burners become increasingly blocked with graphite.

SUMMARY OF THE INVENTION

It is an object of the present invention to reduce the risk of blockage of the rich-gas ducts which extend to a heating flue and the burners which extend into the heating flues of coke ovens.

In accordance with the present invention, there is provided a method and apparatus for supplying non-preheated gas to the heating flues between oven chambers of a regeneratively-operated coke oven through the provision of burners projecting into the heating flues, the burners including refractory material with a smooth surface.

The walls of the rich-gas ducts and the burners which extend into the heating flues consist of refractory material containing mainly $SiO_2$. The invention is based on the recognition that the very rough surface of such refractory material encourages the precipitation of carbon in a particular manner and, furthermore, that the constant accretion of carbon and the reduction thereof by the passage of air bring about an increase to the cavities in the surface of the refractory silica material. This increase of the cavities is also attributed to the conduction of rich gas which has a reducing action.

It has been recognized that there are materials which can withstand the stresses caused by the temperature changes in the combustion chambers of coke ovens. These materials can be processed into members having a particularly smooth and porefree surface. The accretion of carbon does not take place when methane, and where appropriate, a gas containing other hydrocarbons is conducted over such materials at temperatures of the order of which prevail in the heating flues of coke ovens between 1000° C. and 1600° C., typically 1315° C.

Thus, according to the present invention, the walls of the burners which extend into the heating flues include a refractory material which has a smooth surface. If necessary, the walls of the supply ducts for the non-preheated gas, a so-called rich gas, can consist of a refractory material with a smooth surface to the extent to which such walls are disposed in the hot parts of the oven. Corundum, having a purity of at least 99.9%, is a proven refractory material from which components with a smooth surface can be produced by firing, i.e., sintering. The crystalline structure of corundum changes from a $\gamma$ modification, low temperature form, to a high temperature $\alpha$ modification at about 1100° C. The particle size of the raw corundum material should be less than 50 microns.

As described in *Inorganic Chemistry,* published by John Wiley and Sons, second printing, March 1953, page 754, a modification of aluminum oxide, $Al_2O_3$, is utilized, commonly known as corundum, $\alpha$-$Al_2O_3$. In this structure, each aluminum atom is surrounded octahedrally by six oxygen atoms, and each oxygen atom is surrounded by four aluminum atoms, giving in effect a close-packed lattice of oxygen atoms in which aluminum atoms occupy tetrahedral holes. By comparison, a less common variety, $\gamma$-$Al_2O_3$, has a spinel structure. Surface oxidation yields another oxide, $\gamma'$-$Al_2O_3$, which has a defect rock-salt structure in which a random distribution of $21\frac{2}{3}$ aluminum atoms over 32 lattice positions is found. Corundum is a high-temperature modification; $\gamma Al_2O_3$ a low-temperature modification. Corundum melts at 2030° C. and boils at about 2980° C. Its specific gravity is 3.99, whereas the specific gravity of $\gamma$-$Al_2O_3$ is 3.42 to 3.64. Corundum ranks next to silicon carbide in hardness, about 9 on Mohs' scale.

Aluminum oxide has a high thermal stability, its heat of formation, 402.9 kcal. per mol, being very large. The alpha form is insoluble in and unreactive toward water and is very resistant to attack by aqueous acids. The gamma form is hygroscopic and dissolves in acids. In the low-temperature form, corundum is in the $\gamma$ modification but changes to the $\alpha$ modification at 1100° C. The present invention utilizes the behavior of the $\alpha$ modification in the burners of coke ovens to withstand temperatures higher than 1100° C. which are usually always encountered. The $\gamma'$-$Al_2O_3$ modification cannot be supported in the burners at these temperatures because of the melting point of aluminum which is about 660° C.

According to a further embodiment of the present invention, tubes having thin walls and smooth internal surfaces made from corundum or similar refractory material can be inserted into the burners of silica material and such tubes can be inserted into those parts of the gas supply ducts which are disposed below the heating floor and exposed to high temperatures. Advantageously, the tubes with smooth internal surfaces project beyond the top end blocks of the burners of silica material by a few millimeters.

The burner blocks, made from silica material, are joined to each other by means of annular, perpendicular extensions. The internal openings in these blocks are made correspondingly larger to provide sufficient space for inserting the thin-walled tubes of corundum material. Such tubes can be installed when the brickwork is built. In the case of high burners, such burners can also consist of a plurality of burner members which are placed one on top of the other. It is also feasible to introduce the insert tubes through inspection apertures in the oven roof only after the oven has been heated to an operating temperature. The introduction of tubes in this manner calls for the use of special apparatus which permits the tubes to be precisely inserted into the apertures of the burners.

The advantage of constructing the burner walls of a refractory material with a smooth surface resides in the fact that the accretion of graphite layers is prevented when the gases containing hydrocarbons are passed through the burner openings. Degraphitizing of the rich-gas supply duct in a coke oven having burners with smooth wall surfaces is either completely obviated or the quantity of degraphitizing air can be reduced. This also substantially reduces the heat consumption inherent in the coke oven operation.

The present invention is applicable for use with all coke oven constructions wherein heating is performed by rich gas, i.e., in the underjet oven in which rich gas is supplied to each individual burner through a duct which extends through the regenerator separating walls from the basement. The rich gas is controlled by nozzles installed at the basement. The invention is also applicable for use in the so-called overhead-heated coke ovens in which rich gas is supplied from two coke oven heads via a duct which extends above the regenerators and from which branches extend to the floor of the individual heating flues where regulating elements are frequently provided.

These features and advantages of the present invention as well as others will be more fully understood when the following description is read in light of the accompanying drawings, in which.

Figure 1:
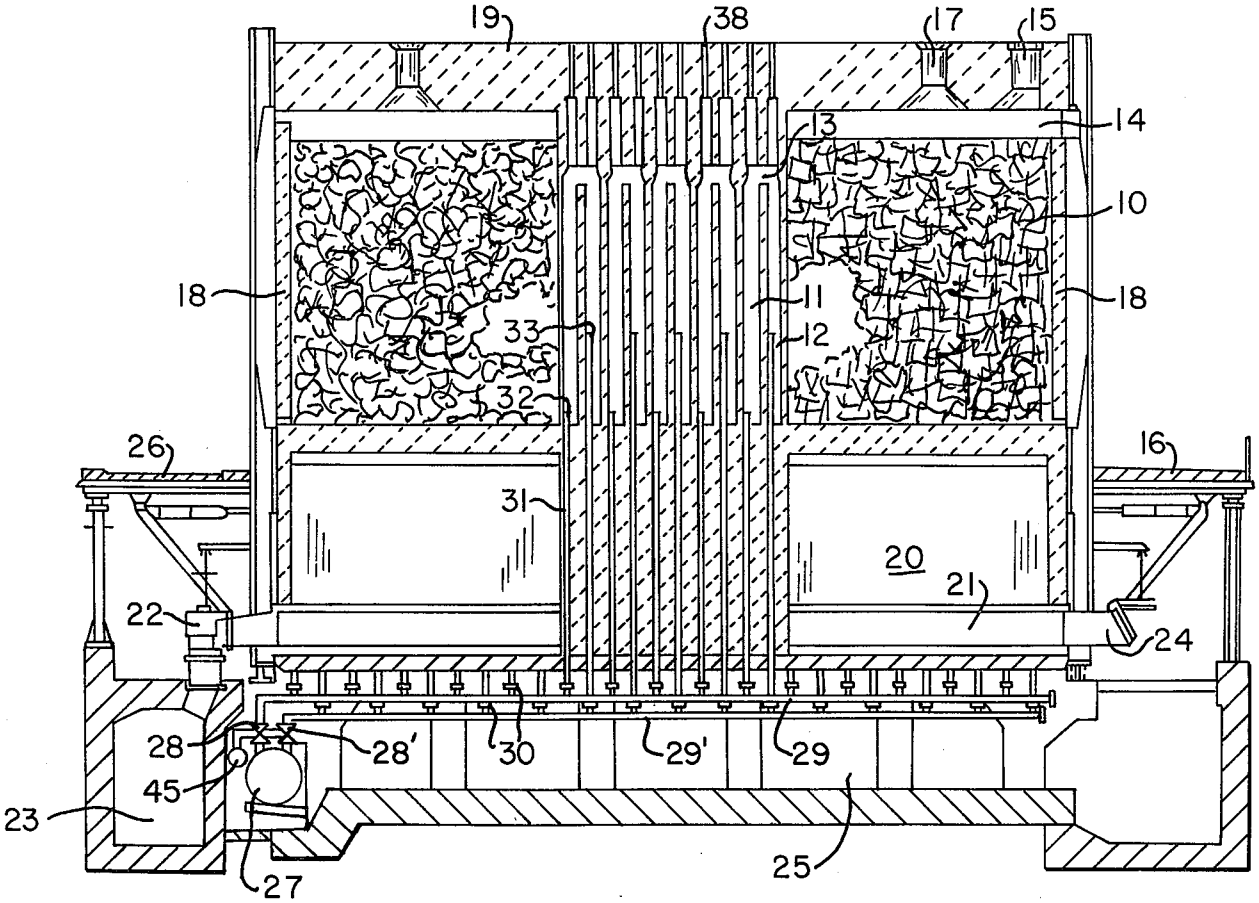
FIG. 1 is a sectional view taken vertically through part of a coke oven chamber and partially through a heating wall divided into twin-heating flues forming part of a battery of underjet coke ovens.

The underjet battery of coke ovens as shown in FIG. 1 includes horizontal coke oven chambers, one of which is identified by the reference numeral 10 having heating walls at the sides thereof which include twin-heating flues in each heating wall. Odd-numbered heating flues are identified by reference numeral 11 and even-numbered heating flues are identified by reference numeral 12. In the heating wall there is an upward burning and a downward burning heating flue interconnected by an aperture 13 which forms a twin-heating flue. In an oven chamber, a gas-collecting chamber 14 is defined by the free space above a coal charge and connected to an aperture 15 in an oven roof 19. An ascension pipe is coupled to the aperture 15 for delivering gas to a gas-collecting main in the usual and well-known manner. Charging holes 17 in the oven roof are used to pass a coal charge into the oven chamber which is closed by removable doors 18, one at the pusher side and one at the coke side of the chamber. A platform 16 extends along the pusher side of the oven chamber and a platform 26 extends along the coke side thereof. Inspection apertures 38 extend through the oven roof into each of the heating flues 11 and 12.

Regenerators 20 preheat combustion air for combustion of rich gas in the heating flues for heating the oven chambers. The regenerators receive waste heat from the burnt gases discharged from the heating flues. The regenerators 20 are connected to a regenerator floor duct 21 receiving air from the pusher side of the oven chamber through flap 24 when moved to the open position. The regenerator duct 21 carries burnt gases that pass through an exhaust heat valve 22 into a smoke-gas collecting duct 23.

As is typical in an underjet battery of coke oven chambers, there is a basement 25 that includes a rich-gas distribution duct 27 extending along the coke oven battery. Rich gas is conducted from the duct via reversing valves 28 and 28' (e.g., three-way cocks) into individual nozzle ducts 29 and 29', respectively, extending along the basement chamber 25 for each heating wall. Rich gas passes from the nozzle ducts by way of adjustable nozzles 30, which can be operated from the basement chamber, into rich-gas ducts 31 extending in the separator walls for the regenerators and into the floor of the heating flues. Nozzle ducts 29 are connected to the odd-numbered heating flues 11 and nozzle ducts 29' are connected to the even-numbered heating flues 12. The reversing valves 28 and 28' are positioned such that when gas is interrupted, degraphitizing air from header 45 is delivered to the burners. Burners are mounted upon the ducts 31 in the heating flues. Low burners 32 are disposed in the odd-numbered heating flues 11; while taller or longer burners 33 are disposed in the even-numbered heating flues 12. The burners are constructed from annular blocks 34 each having a bottom extension 35 extending into a recess in the underlying block. Blocks 34 of the burners bear on transverse walls 39 of the heating flues. Openings 37 extend vertically from the top end of the regenerators to the heating flues and supply preheated air from the regenerators to the flues and direct burnt gases from the flues to the regenerators.

According to the present invention, there is provided thin-walled tubes 36 made of corundum or other similar refractory material. Each tube has a smooth surface so as to prevent the accretion of carbon that precipitates when rich gas is conducted into high-temperature zones of the flues. A tube 36 is inserted into blocks 34 which are provided with an enlarged internal opening corresponding to the outer diameter of the tube.

Figure 2:
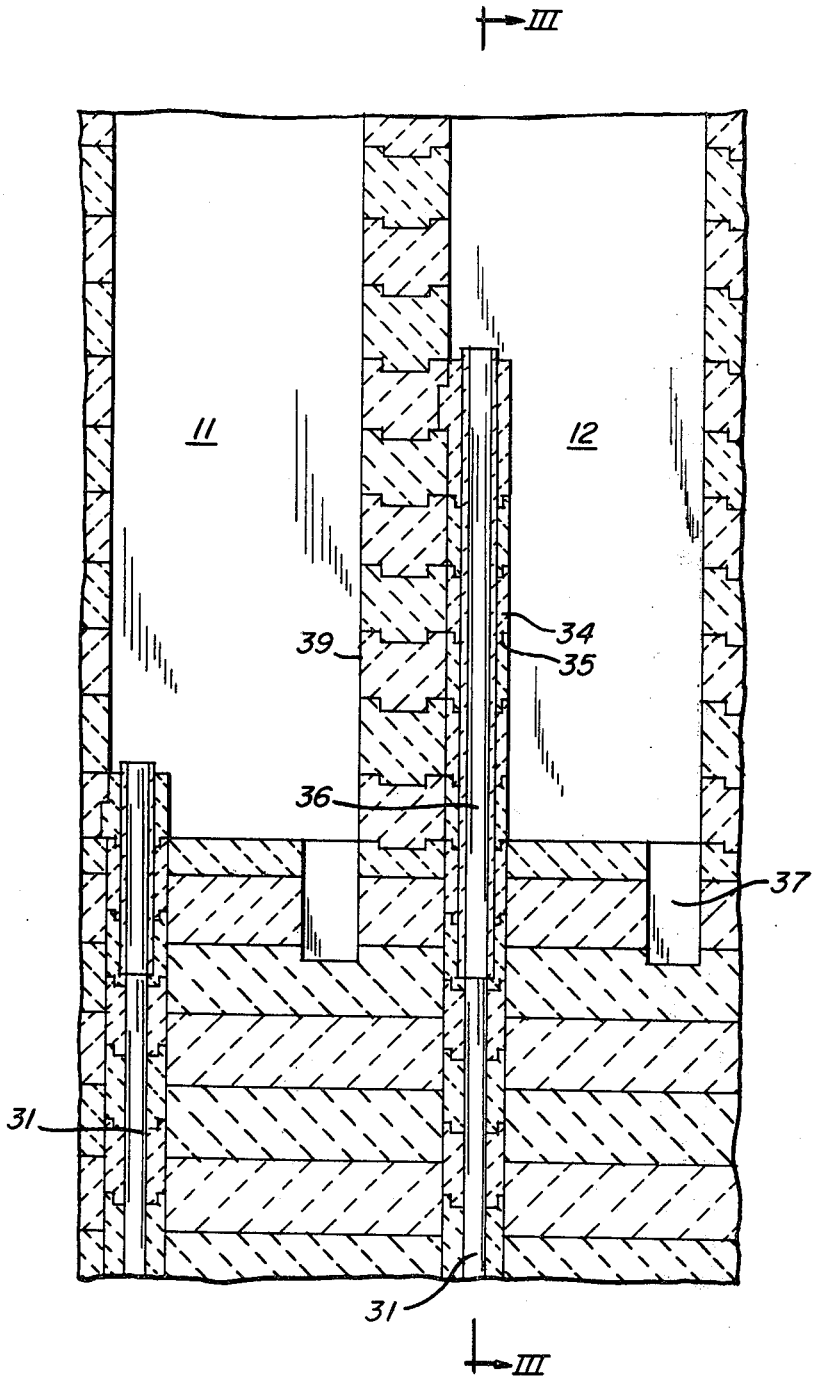
FIG. 2 is an enlarged view showing the bottom part of a pair of twin-heating flues for the battery of coke ovens shown in FIG. 1.
Figure 3:
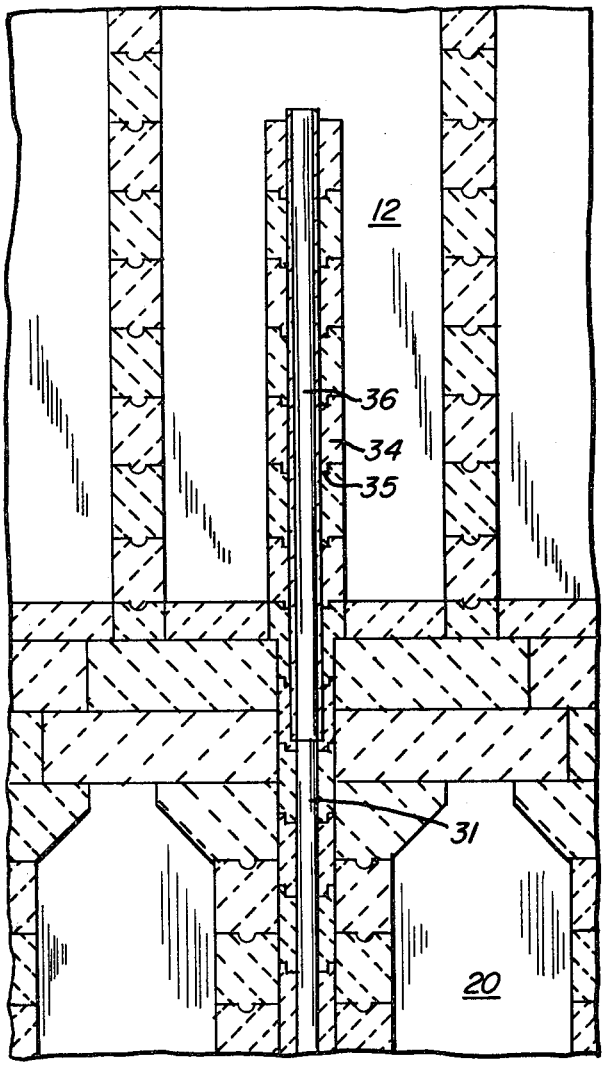
FIG. 3 is a sectional view taken along line III—III of FIG. 2.

The rich-gas ducts 31 and the burner blocks 34 are usually made from silica material. As shown in FIGS. 2 and 3, the tubes 36 extend within the openings in the burner blocks into the top ends of the ducts 31 and the tubes 36 project by a few millimeters beyond the top block 34 forming the burner. In this way, the opening provided by the tubes in the burners always remains free of graphite deposits. As described hereinbefore, the tubes have thin walls and a smooth internal surface that is pore-free. It is preferred to construct the tube from corundum material having a purity of at least 99.9%. The particle size of the raw corundum compound of refractory material should be less than 50 microns. The material is then formed into the desired tube and fired.

Experiments with tubes to form burner walls show that a tube made of corundum-mullite with about 80% $Al_2O_3$ was destroyed within several weeks of coke oven operation. However, tubes made of sintered corundum according to the present invention were proven to be continually usable without alterations after several months of operation. The mullite constituent in the 80% $Al_2O_3$ tubes failed, it is believed, due to the reducing action by the rich gas. The $SiO_2$ component was transformed into SiO and this change in structure brought about the destruction of the material. At a temperature in the range of 1000° C. to 1600° C., it was a surprising discovery that carbon deposits will not occur on a smooth, pore-free surface of refractory material according to the present invention from gas containing methane and its homologues. Observations of burner operation were made through inspection apertures, such as identified by reference numeral 38 in FIG. 1, during the experimental operation. The inner walls of the burners without a smooth wall surface were found to contain heavy graphite deposits after only one regenerative half period, e.g., 30 minutes. The inner walls of the burners with smooth surfaces of the present invention in another row of heating flues were observed to contain only very little deposits of graphite.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. Apparatus for supplying non-preheated gas to heating flues between oven chambers of a regeneratively-heated coke oven, said apparatus including burners projecting into said heating flues, said burners having a lining forming a gas-conducting wall surface consisting of a refractory material capable of withstanding temperatures of at least 1000° C. and defining a smoothness sufficient to substantially prevent accretion of carbon on said wall surface at said temperatures.

2. The apparatus according to claim 1 wherein said refractory material consists of sintered corundum.

3. The apparatus according to claim 1 wherein said refractory material has a particle size less than 50 microns.

4. The apparatus according to claim 1 wherein said burners consist of silica material each having an opening to receive a pipe having an opening defining said gas-conducting burner wall surface.

5. The apparatus according to claim 4 wherein said pipe projects beyond blocks of silica material defining part of said burner.

6. The apparatus according to claim 5 wherein said burners include burner blocks which enter and extend upwardly in said heating flues.

7. The apparatus according to claim 6 wherein said burners include refractory walls including silica for supporting said gas-conducting burner wall surface which consists of corundum.

8. The apparatus according to claim 4 wherein each of said pipes is inserted into a burner and extends into gas supply ducts disposed below the floor of the heating flues and exposed to said temperatures.

* * * * *

UNITED STATES PATENT OFFICE

CERTIFICATE OF CORRECTION

Patent No. 4,347,106 Dated August 31, 1982

Inventor(s) FOLKARD WACKERBARTH

It is certified that error appears in the above-identified patent and that said Letters Patent are hereby corrected as shown below:

On the title insert:

-- Foreign Application Priority Data

September 6, 1978 (DE) Fed. Rep. of Germany 2838719 --.

Signed and Sealed this

*Sixteenth* Day of *October 1984*

[SEAL]

*Attest:*

GERALD J. MOSSINGHOFF

*Attesting Officer*

*Commissioner of Patents and Trademarks*